US008314679B2

(12) United States Patent
Hsieh

(10) Patent No.: US 8,314,679 B2
(45) Date of Patent: Nov. 20, 2012

(54) MONITORING SYSTEM AND INPUT DEVICE THEREOF

(75) Inventor: Ming-Chih Hsieh, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 426 days.

(21) Appl. No.: 12/781,933

(22) Filed: May 18, 2010

(65) Prior Publication Data

US 2011/0175720 A1 Jul. 21, 2011

(30) Foreign Application Priority Data

Jan. 16, 2010 (CN) ..... 2010 1 0300351

(51) Int. Cl.
*G05B 23/02* (2006.01)

(52) U.S. Cl. ..... 340/3.1; 340/426.1; 340/539.22; 340/425.5; 324/713

(58) Field of Classification Search ..... 340/3.1, 340/539.22, 501, 426.1, 425.5
See application file for complete search history.

(56) References Cited

U.S. PATENT DOCUMENTS

| | | | | |
|---|---|---|---|---|
| 5,652,566 | A * | 7/1997 | Lambert | 340/507 |
| 6,888,453 | B2 * | 5/2005 | Lutz et al. | 340/506 |
| 7,447,612 | B2 * | 11/2008 | Keyes et al. | 340/3.1 |
| 7,889,105 | B2 * | 2/2011 | Zushi et al. | 341/120 |
| 8,183,538 | B2 * | 5/2012 | Frank | 250/394 |
| 2003/0128126 | A1 * | 7/2003 | Burbank et al. | 340/605 |
| 2004/0222884 | A1 * | 11/2004 | Costa et al. | 340/522 |

* cited by examiner

*Primary Examiner* — Eric M Blount
(74) *Attorney, Agent, or Firm* — Altis Law Group, Inc.

(57) ABSTRACT

A monitoring system includes a controller, a number of input devices, a number of digital sensors, a number of analog sensors, and a number of alarms. Each input device comprises a switching circuit, an input circuit, and a connector. The connector is connected to a digital sensor or connected to an analog sensor and a first power source in series. The controller controls the switching circuit of the input device to receive a digital signal of the digital sensor or an analog signal of the analog sensor and output a corresponding detection signal. The input circuit transmits the detection signal to the controller. The controller controls the corresponding alarm to work according to the detection signal.

14 Claims, 4 Drawing Sheets

MONITORING SYSTEM AND INPUT DEVICE THEREOF

CROSS-REFERENCE

Relevant subject matter is disclosed in six co-pending U.S. patent application Ser. Nos. 12/641,230, 12/781,927, 12/770,779, 12/781,940, 12/781,951, and 12/781,954) assigned to the same assignee as this patent application.

BACKGROUND

1. Technical Field

The present disclosure relates to monitoring systems and, particularly, to a monitoring system with input devices.

2. Description of Related Art

Most monitoring systems are designed to monitor certain conditions such as temperature or pressure changes. The number of conditions may be limited and as such the number of input devices or sensors are fixed. Further, some input devices are integrated into the monitoring system. As a result, it is inconvenient to modify such a monitoring system to expand its input capability.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure with the accompanying drawings is illustrated by way of examples and not by way of limitation, in which like references indicate similar elements. It should be noted that references to "an" or "one" embodiment in this disclosure are not necessarily to the same embodiment, and such references mean at least one.

Figure 1:
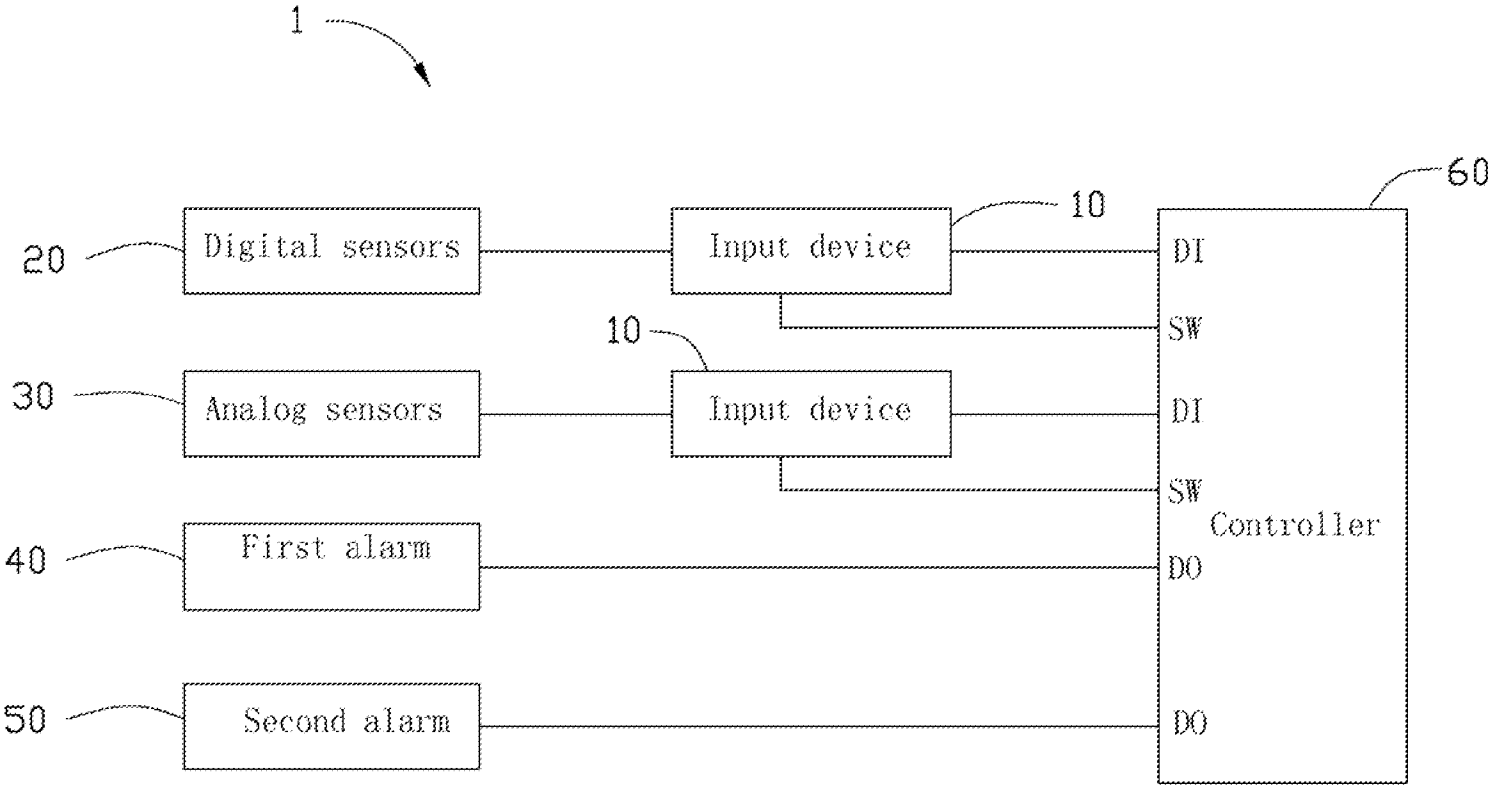
FIG. 1 is a schematic block diagram of an exemplary embodiment of a monitoring system, the monitoring system including input devices.

Referring to FIG. 1, an exemplary embodiment of a monitoring system 1 includes two input devices 10, a digital sensor 20, an analog sensor 30, a first alarm 40, a second alarm 50, and a controller 60. In another embodiment, the monitoring system 1 may include a plurality of input devices 10, a plurality of digital sensors 20, a plurality of analog sensors 30, a plurality of first alarms 40, a plurality of second alarms 50, and a controller 60. A sum of the digital sensors 20 and the analog sensors 30 is equal to the number of the input devices 10. In the embodiment, the analog sensors 40 are temperature sensors. Each digital sensor 30 may be mounted in a locale, such as on a door. When the door is open, a switch of the digital sensor 30 is turned off. When the door is closed, the switch of the digital sensor 30 is turned on. There is one first alarm 40 for each digital sensor 20, and one second alarm 50 for each analog sensor 30.

The controller 60 includes a plurality of input terminals DI, a plurality of output terminals DO, and a plurality of control terminals SW.

Each input device 10 is connected between one of the digital sensors 20 or one of the analog sensors 30, and one of the input terminals DI of the controller 60. Each input device 10 is also connected to one of the control terminals SW of the controller 60. The first alarms 40 and the second alarms 50 are respectively connected to the output terminals DO of the controller 60.

When an input device 10 is connected to one of the digital sensors 20, the input device 10 converts a digital signal of the digital sensor 20 to a first detection signal and transmits the first detection signal to the controller 60. When an input device 10 is connected to one of the analog sensors 30, the input device 10 converts an analog signal of the analog sensor 30 to a second detection signal and transmits the second detection signal to the controller 60. The controller 60 controls the corresponding first alarm 40 to work according to the first detection signal. The controller 60 controls the corresponding second alarm 50 to work according to the second detection signal.

Figure 2:
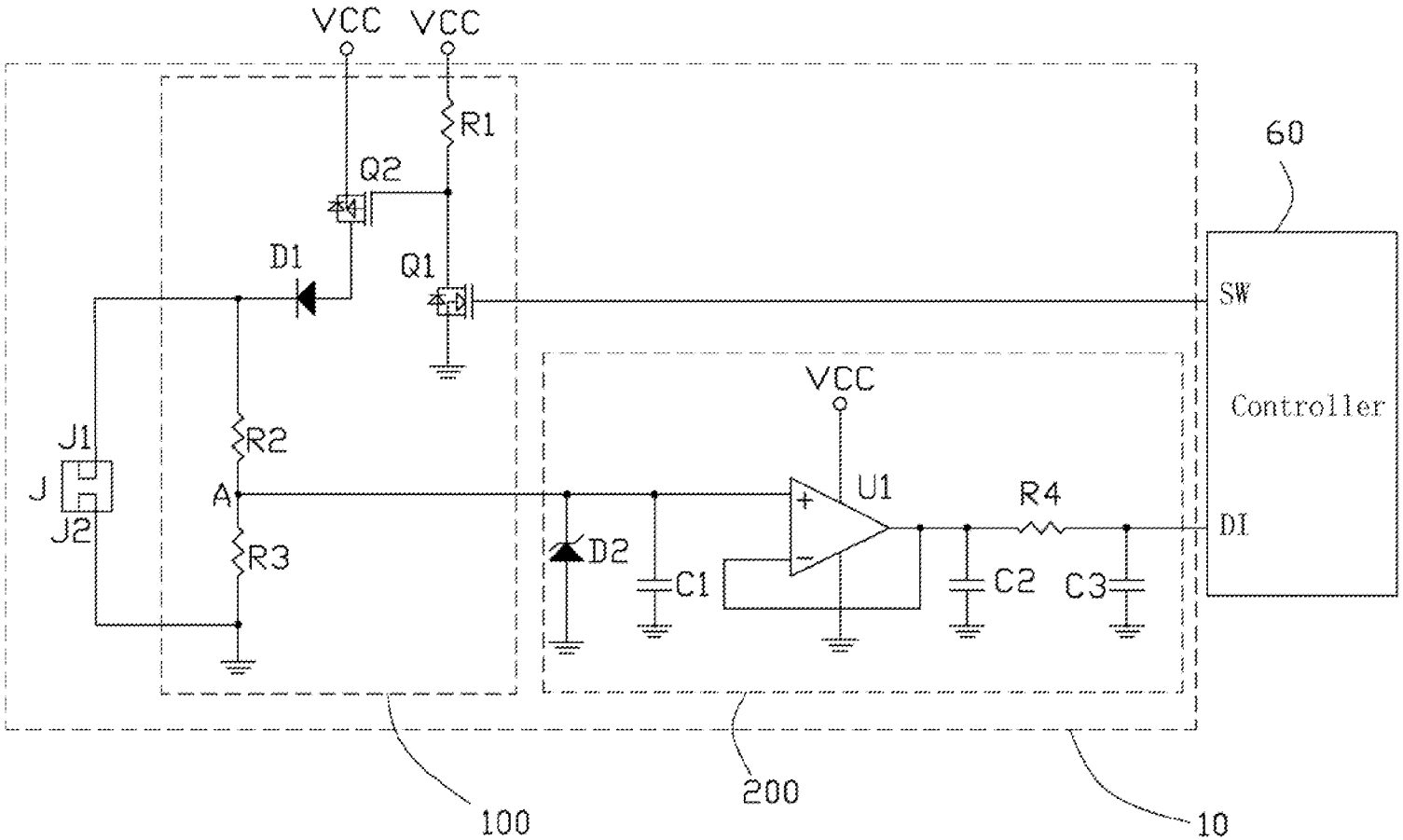
FIG. 2 is a schematic diagram of one of the input devices in FIG. 1.

Referring to FIG. 2, the input device 10 includes a switching circuit 100, an input circuit 200, and a connector J. The switching circuit 100 is connected between a control terminal SW of the controller 60 and the connector J. The input circuit 200 is connected between the switching circuit 100 and an input terminal DI of the controller 60. The connector J is connected to the digital sensor 20 or the analog sensor 30.

The switching circuit 100 receives the digital signal of the digital sensor 20 or the analog signal of the analog sensor 30 and outputs the first detection signal or the second detection signal. The input circuit 200 transmits the first detection signal or the second detection signal to the controller 60.

The controller 60 controls status of the switching circuit 100 and receives the first detection signal and the second detection signal. When the input device 10 is connected to the digital sensor 20, the controller 60 controls the switching circuit 100 to receive the digital signal of the digital sensor 20. At the same time, the controller 60 receives the first detection signal via the input circuit 200. When the input device 10 is connected to the analog sensor 30, the controller 60 controls the switching circuit 100 to receive the analog signal of the analog sensor 30. At the same time, the controller 60 receives the second detection signal via the input circuit 200.

The controller 60 controls the first alarm 40 to work according to the first detection signal. The controller 60 controls the second alarm 50 to work according to the second detection signal. For example, the controller 60 controls the first alarm 50 to alarm when the controller 60 receives a first detection signal indicating that temperature is less than a predetermined value.

The switching circuit 100 includes metal-oxide-semiconductor field effect transistors (MOSFETs) Q1 and Q2, a diode D1, and resistors R1~R3. The MOSFET Q1 is an n-channel MOSFET. The MOSFET Q2 is a p-channel MOSFET.

A drain of the MOSFET Q1 is connected to a power source VCC via the resistor R1. A gate of the MOSFET Q1 is connected to the control terminal SW of the controller 60. A source of the MOSFET Q1 is grounded. A gate of the MOSFET Q2 is connected to the drain of the MOSFET Q1. A source of the MOSFET Q2 is connected to the power source VCC. An anode of the diode D1 is connected to a drain of the MOSFET Q2. A cathode of the diode D1 is connected to a first terminal J1 of the connector J. A first terminal of the resistor R3 is connected to the first terminal J1 of the connector J via the resistor R2. A second terminal of the resistor R3 is connected to a second terminal J2 of the connector J and grounded.

The input circuit 200 includes a voltage stabilizing diode D2, an operational amplifier U1, a resistor R4, and capacitors C1~C3. The voltage stabilizing diode is a Zener diode.

A cathode of the voltage stabilizing diode D2 is connected to a node A between the resistors R2 and R3. An anode of the voltage stabilizing diode D1 is grounded.

A non-inverting input of the operational amplifier U1 is connected to the cathode of the voltage stabilizing diode D2, and grounded via the capacitor C1. An inverting input of the operational amplifier U1 is connected to an output of the operational amplifier U1. A power terminal of the operational amplifier U1 is connected to the power source VCC. A ground terminal of the operational amplifier U1 is grounded. The output of the operational amplifier U1 is also grounded via the capacitor C2.

A first terminal of the resistor R4 is connected to the output of the operational amplifier U1. A second terminal of the resistor R4 is connected to the input terminal DI of the controller 60 and grounded via the capacitor C3. The resistor R4 and the capacitors C2 and C3 compose a pi-type filter to filter high frequency signals from the output of the operational amplifier U1.

Figure 3:
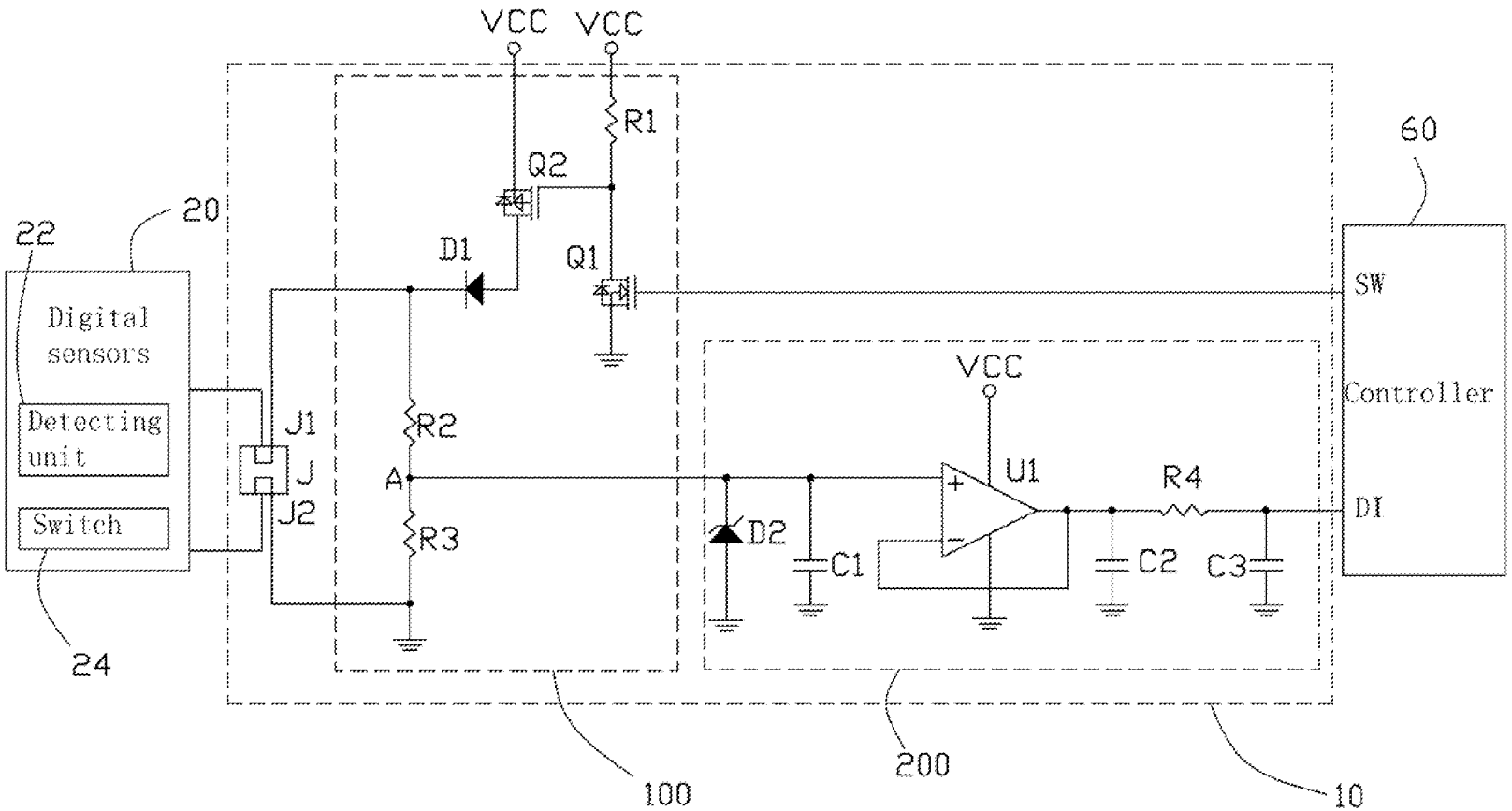
FIG. 3 is a schematic diagram of one of the input devices of FIG. 2 connected to a digital sensor.

Referring to FIG. 3, the digital sensor 20 includes a detecting unit 22 and a switch 24. When the first terminal J1 of the connector J, the digital sensor 20, and the second terminal J2 of the connector J are connected in series, the control terminal SW of the controller 60 is set at a high voltage level. The MOSFET Q1 of the switching circuit 100 is turned on. The gate of the MOSFET Q2 is at a low voltage level. The MOSFET Q2 is turned on.

The relationship of the voltage Vb of the node between the resistor R2 and the diode D1, and voltage Va of the node A, and the resistances of the resistors R2 and R3 is shown as below.

$$Va=Vb\times R3/(R2+R3)$$

When the door is open, the switch 24 of the digital sensor 20 is turned off. The node A is at a high voltage level. The input terminal DI of the controller 60 receives the output of the operational amplifier U1 via the resistor R4. The output of the operational amplifier U1 is approximately equal to the input voltage Va. The controller 60 determines that the door is open because the input terminal DI of the controller 60 is at a high voltage level.

When the door is closed, the switch 24 of the digital sensor 20 is turned on. The voltage Vb of the node between the resistor R2 and the diode D1 is 0 volts.

The node A is at a low voltage level. The input terminal DI of the controller 60 receives the output of the operational amplifier U1. The controller 60 determines that the door is closed because the input terminal DI of the controller 60 is at a low voltage level.

Figure 4:
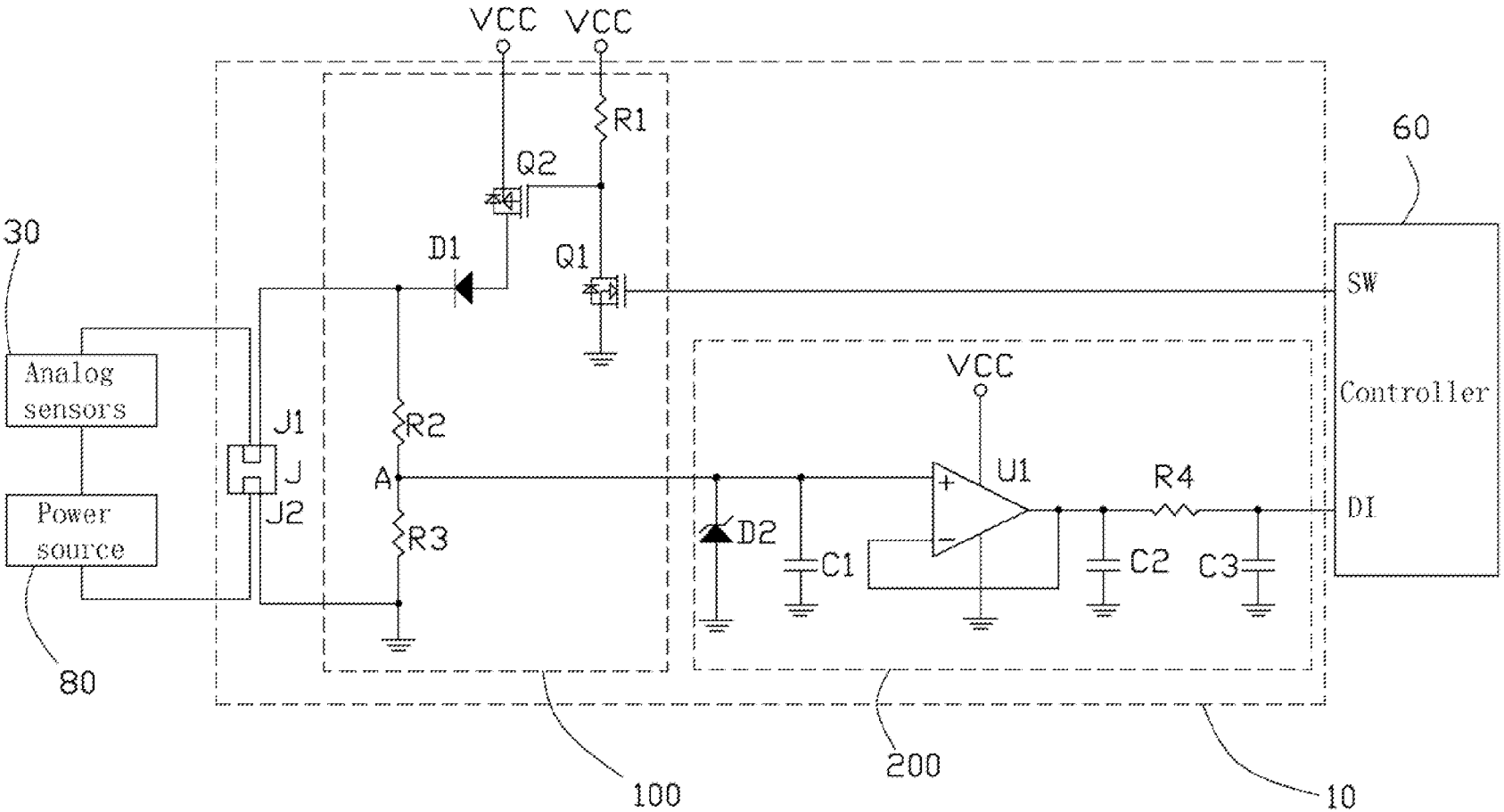
FIG. 4 is a schematic diagram of one of the input devices of FIG. 2 connected to an analog sensor.

Referring to FIG. 4, when the first terminal J1 of the connector J, the analog sensor 30, a power source 80, and the second terminal J2 of the connector J are connected in series, the control terminal SW of the controller 60 is set at a low voltage level. The MOSFET Q1 of the switching circuit 100 is turned off. The gate of the MOSFET Q2 is at a high voltage level. The MOSFET Q2 is turned off.

The analog sensor 30 detects temperature, and the voltage Vb of the node between the resistor R2 and the diode D1 changes correspondingly to changing of the temperature. The relationship of the voltage Vb of the node between the resistor R2 and the diode D1, the voltage Va of the node A, resistances of the resistors R2 and R3 is shown as below.

$$Va=Vb\times R3/(R2+R3)$$

The input terminal DI of the controller 60 receives the output of the operational amplifier U1 via the resistor R4. The output of the operational amplifier U1 is approximately equal to the input voltage Va. The controller 60 stores a plurality of voltage values and a plurality of corresponding temperature values. The controller 60 determines temperature of the analog sensor 30 by comparing the input voltage Va with the temperature values.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A monitoring system, comprising:

a controller comprising a plurality of input terminals, a plurality of output terminals, and a plurality of control terminals;

a plurality of digital sensors;

a plurality of analog sensors;

a plurality of input devices, wherein a sum of the plurality of digital sensors and the plurality of analog sensors is equal to a number of the plurality of input terminals of the controller, each input device is connected between an input terminal of the controller and one of the plurality of digital sensors or one of the plurality of analog sensors, each input device is also connected to a control terminal of the controller, each input device comprises a switching circuit, an input circuit, and a connector, the connector is connected to one of the plurality of digital sensors or connected to one of the plurality of analog sensors and a first power source in series, wherein when an input device is connected to a digital sensor, the switching circuit receives a digital signal of the digital sensor and outputs a first detection signal, the input circuit transmits the first detection signal to the controller; when the input device is connected to an analog sensor, the switching circuit receives an analog signal of the analog sensor and outputs a second detection signal, the input circuit transmits the second detection signal to the controller;

a plurality of first alarms connected to some of the plurality of output terminals of the controller, respectively, wherein a number of the plurality of first alarms is equal to the number of the plurality of digital sensors, the controller controls a first alarm according to the first detection signal; and a plurality of second alarms connected to the others of the plurality of output terminals of the controller, wherein a number of the plurality of second alarms is equal to the number of the plurality of analog sensors, the controller controls a second alarm according to the second detection signal.

2. The monitoring system of claim 1, wherein the plurality of analog sensors are temperature sensors.

3. The monitoring system of claim 1, wherein the switching circuit comprises an n-channel metal-oxide-semiconductor field effect transistor (MOSFET), a p-channel MOSFET, a diode, a first resistor, a second resistor, and a third resistor, a drain of the n-channel MOSFET is connected to a second power source via the first resistor, a gate of the n-channel MOSFET is connected to the control terminal of the controller, a source of the n-channel MOSFET is grounded, a gate of the p-channel MOSFET is connected to the drain of the n-channel MOSFET, a source of the p-channel MOSFET is connected to the second power source, an anode of the diode is connected to a drain of the p-channel MOSFET, a cathode of the diode is connected to a first terminal of the connector, a first terminal of the third resistor is connected to the first terminal of the connector via the second resistor, a second terminal of the third resistor is connected to a second terminal of the connector and grounded.

4. The monitoring system of claim 3, wherein the input circuit comprises a voltage stabilizing diode, an operational amplifier, and a fourth resistor, a cathode of the voltage stabilizing diode is connected to a node between the second resistor and the third resistor, an anode of the voltage stabilizing diode is grounded, a non-inverting input of the operational amplifier is connected to the cathode of the voltage stabilizing diode, an inverting input of the operational amplifier is connected to an output of the operational amplifier, a first terminal of the fourth resistor is connected to the output of the operational amplifier, a second terminal of the fourth resistor is connected to the input terminal of the controller.

5. The monitoring system of claim 4, wherein a first capacitor is connected between the non-inverting input of the operational amplifier and ground.

6. The monitoring system of claim 4, wherein a first capacitor is connected between the output of the operational amplifier and ground.

7. The monitoring system of claim 6, wherein a second capacitor is connected between the second terminal of the fourth resistor and ground.

8. An input device connected between a controller and a digital sensor or an analog sensor, the input device comprising:

a connector connected to the digital sensor or connected to the analog sensor and a first power source in series;

a switching circuit connected between a control terminal of the controller and the connector, wherein when the connector is connected to the digital sensor, the switching circuit receives a digital signal of the digital sensor and outputs a first detection signal, when the connector is connected to the analog sensor, the switching circuit receives an analog signal of the analog sensor and outputs a second detection signal; and an input circuit connected between the switching circuit and an input terminal of the controller, wherein the input circuit transmits the first or second detection signal from the switching circuit to the controller.

9. The input device of claim 8, wherein the analog sensor is a temperature sensor.

10. The input device of claim 8, wherein the switching circuit comprises an n-channel metal-oxide-semiconductor field effect transistor (MOSFET), a p-channel MOSFET, a diode, a first resistor, a second resistor, and a third resistor, a drain of the n-channel MOSFET is connected to a second power source via the first resistor, a gate of the n-channel MOSFET is connected to the control terminal of the controller, a source of the n-channel MOSFET is grounded, a gate of the p-channel MOSFET is connected to the drain of the n-channel MOSFET, a source of the p-channel MOSFET is connected to the second power source, an anode of the diode is connected to a drain of the p-channel MOSFET, a cathode of the diode is connected to a first terminal of the connector, a first terminal of the third resistor is connected to the first terminal of the connector via the second resistor, a second terminal of the third resistor is connected to a second terminal of the connector and grounded.

11. The input device of claim 10, wherein the input circuit comprises a voltage stabilizing diode, an operational amplifier, and a fourth resistor, a cathode of the voltage stabilizing diode is connected to a node between the second resistor and the third resistor, an anode of the voltage stabilizing diode is grounded, a non-inverting input of the operational amplifier is connected to the cathode of the voltage stabilizing diode, an inverting input of the operational amplifier is connected to an output of the operational amplifier, a first terminal of the fourth resistor is connected to the output of the operational amplifier, a second terminal of the fourth resistor is connected to the input terminal of the controller.

12. The input device of claim 11, wherein a first capacitor is connected between the non-inverting input of the operational amplifier and ground.

13. The input device of claim 11, wherein a first capacitor is connected between the output of the operational amplifier and ground.

14. The input device of claim 13, wherein a second capacitor is connected between the second terminal of the fourth resistor and ground.

* * * * *